United States Patent [19]

Newman

[11] 4,359,008

[45] Nov. 16, 1982

[54] APPARATUS FOR PROVIDING A ZIPPER CLOSABLE GARMENT POCKET ENTRY

[76] Inventor: Sydney Newman, 1245 Ave. X, Brooklyn, N.Y. 11235

[21] Appl. No.: 168,775

[22] Filed: Jul. 11, 1980

[51] Int. Cl.[3] ..... D05B 3/12

[52] U.S. Cl. ..... 112/104; 112/128; 112/265.2; 2/265

[58] Field of Search ..... 112/104, 113, 105, 122, 112/128, 121.19, 121.27, 265.2; 2/265, 247

[56] References Cited

U.S. PATENT DOCUMENTS

| | | | |
|---|---|---|---|
| 2,388,516 | 11/1945 | Altobelli | 2/247 |
| 3,003,445 | 10/1961 | Crystal | 2/265 X |
| 3,570,434 | 3/1971 | Gustavsson | 112/265.2 |
| 3,710,745 | 1/1973 | Yoshikawa | 112/265.2 |
| 3,968,523 | 7/1976 | Newman | 2/265 |
| 4,103,562 | 8/1978 | Boser | 112/104 X |
| 4,169,421 | 6/1978 | Foults | 112/104 |
| 4,274,347 | 6/1981 | Rohren | 112/104 |
| 4,297,954 | 5/1980 | Gauthier | 112/104 |

*Primary Examiner*—H. Hampton Hunter

*Attorney, Agent, or Firm*—Hubbell, Cohen, Stiefel & Gross

[57] ABSTRACT

A sewing machine (10) for mass producing zipper closable garment pocket entries (65) includes a pair of pocket entry (65) in a plurality of garments (50,72,80). The apparatus 10 is a modification of a conventional type of double needle sewing machine and includes knife blades (18) spaced laterally apart from each other which cooperate with a pair of conventional double needles (12) to cut in advance of each stitch (58) and enable provision of a square miter at the ends of each finished pocket entry (65). The knife blades (18) are disposable between and behind the two needles (12) in the material feed direction. A feeder mechanism feeds continuous zipper tape (38) across the throat plate (16) beneath the needles (12) and knife blades (18) which may be selectively lowered and raised by the operator. The knife blades (18) operate in conjunction with the needle bar (14) movement only when engaged so as to cut in advance of each stitch while being unaffected by needle bar movement when disengaged. The zipper tape (38) is thus sewn onto the garment as it is advanced across the throat plate (16) while the engaged knife blades (18) simultaneously cut two parallel longitudinal slits (60) in the garment (50,72,80) at the pocket location between the outer extremeties of the sewn zipper tape (38). A conventional zipper slide (68) provided on the zipper chain (44,46) is used to lock the two sewn chains (44,46) together in place with a zipper fastener (70) being provided at the ends of each pocket entry (65) to provide the zipper closure. The pocket closure (65) is finished by transversely cutting (63) the slit garment material adjacent the ends of the slits to complete the square miter at these ends which are tucked in to finish the pocket entry (65).

14 Claims, 20 Drawing Figures

APPARATUS FOR PROVIDING A ZIPPER CLOSABLE GARMENT POCKET ENTRY

TECHNICAL FIELD

The present invention relates to a method and apparatus for providing a closable pocket entry having a zipper closure therefor, the method and apparatus being particularly adapted to mass production of such closable pocket entries in garments.

BACKGROUND ART

In U.S. Pat. No. 3,968,523 issued on July 13, 1976 to the present applicant, various known prior art patents relating to zipper tapes and the production of zipper closures for garments were discussed and such discussion is specifically incorporated by reference herein as it relates to U.S. Pat. Nos. 3,570,434; 2,378,719; 3,081,462 and 2,638,650, none of which suggest a method of manufacturing zipper closable pockets for garments which could be readily adapted to mass production techniques. Furthermore, none of the other prior art cited in U.S. Pat. No. 3,968,523, namely U.S. Pat. Nos. 2,388,516; 2,527,224; 2,573,046; 2,823,388; 3,225,429; 3,685,562; 3,710,745 and 3,729,959 discloses or suggests any such method or apparatus.

In an attempt to overcome the disadvantages of the prior art, the present applicant's previous U.S. Pat. No. 3,968,523 provides a method for producing a zipper closable pocket on a garment which is readily adaptable to mass production techniques. The method disclosed in that patent helped to eliminate the costly and time consuming need to individually sew a zipper closure on each pocket of each garment. Although advantageous over the known art, the method of applicant's previous patent required the step of manually mitering the pocket entries in a separate operation by making a plurality of tapering diagonal cuts to form V-shaped flaps at the longitudinal extremeties of the pocket entries. Such separate step required additional special machinery and labor, thereby reducing the efficiency of the disclosed method. The present invention discloses an improved method and apparatus which readily enables provision of a unique square miter at the ends of a zipper closable pocket entry of a garment simultaneously with the sewing operation, thereby eliminating the additional time and equipment required to perform the step of separately having to diagonally miter each of the pocket entries in the various garments.

DISCLOSURE OF THE INVENTION

The present invention provides a method and apparatus for providing a zipper closable pocket entry in a garment at a predetermined pocket location therein. The method and apparatus are particularly adaptable for use in mass production techniques, with the apparatus being a modification or improvement in a known type of double needle sewing machine, such as the Singer Model No. 112W127. The modified machine includes a throat plate, and control means for selectively lowering and raising a pair of knives into and out of engagement with material advancing across the throat plate. The knives are disposed laterally between the two needles of the sewing machine but spaced behind the needles in the direction of material feed so as to allow for formation of a proper square miter at the ends of the finished pocket entry. Means are provided for feeding a garment and a substantially continuous fastener tape having a continuous zipper chain extending longitudinally thereon across the throat plate as the pocket entries are being formed.

The control arrangement enables the knives to be readily engaged and disengaged from the needle bar movement so that when the knives are engaged, they operate in conjunction with the needle bar movement to cut in advance of each stitch and enable the square miter to be provided at the ends, whereas when the knives are disengaged the needle bar movement may independently occur to merely stitch without any cutting action occurring. This enables stitches to be provided before the first cut of a pocket entry and after the associated last cut for that pocket entry. As the garment and zipper tape is advanced across the throat plate, the needles of the sewing machine sew each of the component strips of the zipper tape to the garment at predetermined positions thereon while the engaged knives simultaneously cut two substantially parallel longitudinal slits in the garment and the zipper tape at the pocket location to define the associated pocket entry which is finished by transversely cutting the slitted garment material adjacent the ends of the slits to complete the square miter at these ends which are tucked in to finish the pocket entry.

BEST MODE FOR CARRYING OUT THE INVENTION

Figure 1:
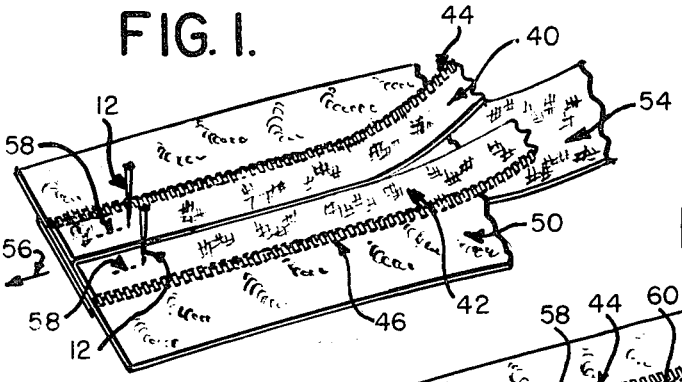
FIG. 1 is a perspective view of the initial step in the formation of a pocket entry in a garment in accordance with the present invention illustrating the step with the knives up, the needles down and the initial stitches for the pocket entry started.

Referring now to the drawings in detail, FIGS. 1–20 illustrate the preferred method and apparatus for forming a zipper closable pocket entry in accordance with the present invention. Specifically, FIGS. 1–9 and 15–20 illustrate the preferred method of the invention while FIGS. 10–14 illustrate the preferred apparatus for performing the disclosed method. FIGS. 1–6 and 9 show the various steps in sequence for forming a typical pocket entry while FIGS. 7–8 and 15–20 illustrate the same method adapted to mass production techniques of such pocket entries in a plurality of garments, such as, for example, two garments.

Referring initially to the apparatus illustrated in FIGS. 10–14, FIGS. 10 and 11, respectively, show side elevational and front views of an improved or modified double needle sewing machine in accordance with the present invention. The improved sewing machine, referred to generally by reference numeral 10, can be a modification of a conventional double needle sewing machine, such as a Singer Model No. 112W127 having a pair of needles 12 mounted to a needle bar 14 for reciprocating motion with respect to a throat plate 16 mounted to the machine beneath the needles 12. The throat plate 16 is conventionally positioned to receive material fed into the machine 10 for sewing. A conventional main motor (not shown) and electrical circuitry 13 are provided for conventionally accomplishing reciprocating drive of the needle bar 14, and material feed via a conventional feed dog mechanism. A pair of knife blades 18 are mounted on a support bar 20 behind the needles 12 in the direction of feed of the material across the throat plate 16. The knife blades 18 and the support bar 20 are preferably coupled to the bottom end of a piston 22 and means are provided for selectively driving the piston 22 between an upper position in which the knife blades 18 are raised above the throat plate 16 and a lower position in which the knife blades 18 are lowered so as to reciprocate with the needle bar 14 and engage material fed across the throat plate 16. As shown and preferred in FIG. 10, the piston driving means includes a driving arm 24 which is coupled to a first foot treadle control (not shown) by linkage 26 and a lever arm 28, and which is coupled to a second foot treadle control (not shown) by linkage 30 and a lever 32. Appropriate openings 34 and 36 are provided at the ends of the lever arms 28 and 32 to engage the respective ends of linkages 26 and 30.

Figure 10:
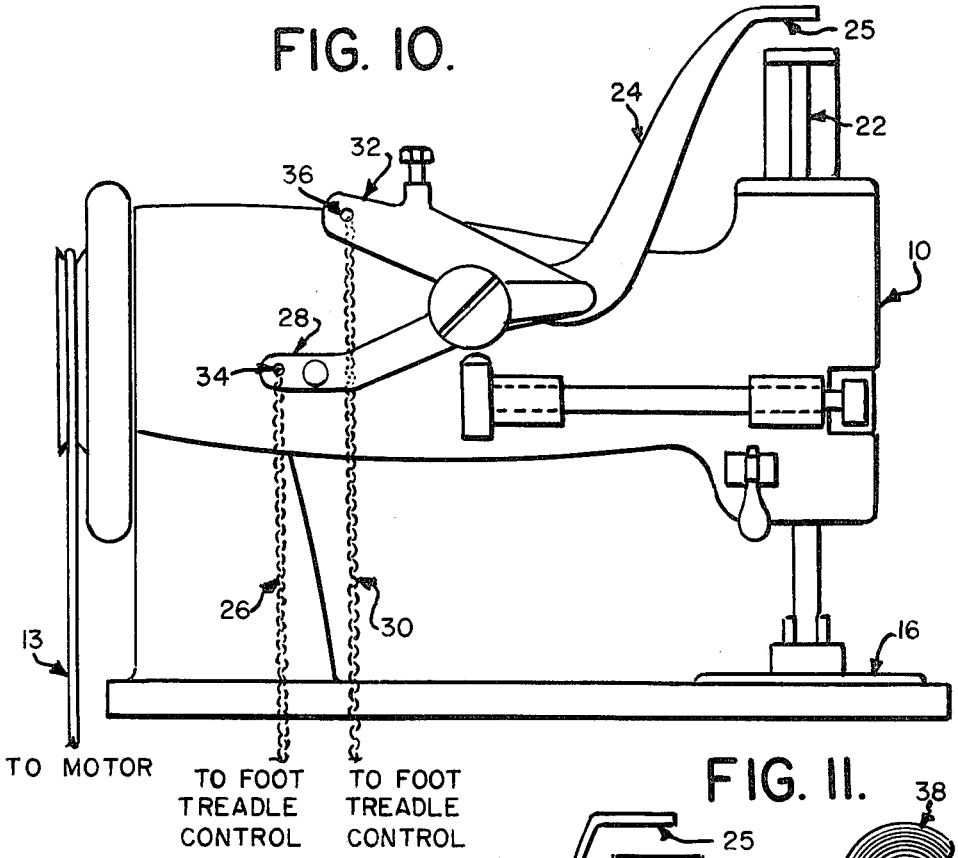
FIG. 10 is a side elevational view of the improved double needle sewing machine in accordance with the present invention, illustrating the treadle control arrangement.
Figure 11:
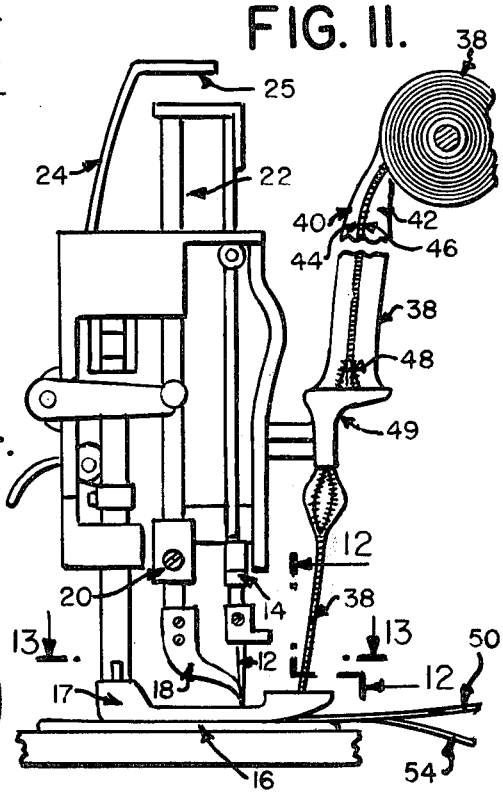
FIG. 11 is an end view of the sewing machine of FIG. 10 illustrating the zipper tape feed and knife and needle control aspects of the present invention.

As an example of the operation of the piston driving means, when tension is exerted on the linkage 30 by depressing the second foot treadle, the lever arm 32 is lowered thereby raising the driving arm 24 above the top of piston 22 as shown in FIGS. 10 and 11. The piston 22, which is preferably upwardly biased, will then rise since it is no longer held down by driving arm 24 and, accordingly, the double knife blades 18 mounted to the bottom of piston 22 will rise a corresponding distance above the throat plate 16 out of engagement with the material and the needle bar 14. When tension is exerted on linkage 26 by depressing the first foot treadle, the lever arm 28 will be depressed to lower the driving arm 24 into engagement with the top of the piston 22. As the driving arm 24 is lowered, the flat end 25 of that arm drives the piston 22 downwardly thereby lowering the double knife blades 18 mounted to the lower end of the piston 22 proximate to the throat plate 16 and into engagement with the needle bar 14 drive so as to enable reciprocation with the needle bar 14 and cut material as it is fed across the throat plate 16, with the knives 18 being positioned so as to cut in advance of each stitch by needles 12. As will be discussed below, the selective engagement and disengagement of the knife blades 18 with the needle bar 14 drive mechanism enables stitches to be provided before and after the cutting of the pocket entry while enabling a square miter to be provided for the pocket entry being formed.

Referring now to FIG. 11, a roll of conventional continuous fastener tape 38 is shown as being fed into the modified sewing machine 10 of the present invention. The fastener tape 38 is conventionally formed from two strips of material 40 and 42, each having a mateable zipper chain 44, 46 extending longitudinally along the inside edge thereof. The zipper tape 38 is normally provided with the zipper chains 44, 46 initially joined together. A splitter 48 and guide 49 are preferably mounted to the front of the machine 10 and interposed between the roll of zipper tape 38 and the throat plate 16 to separate the tape 38 into its two component strips 40 and 42 while twisting these separate strips 40 and 42 to place the respective zipper chains 44 and 46 at the outside edges of the respective strips 40 and 42 prior to being fed across the throat plate 16. The conventional feed dog means (not shown) feeds a garment 50 across the throat plate 16 simultaneously with the feeding of the split and twisted zipper strips 40 and 42 thereacross, such as illustrated in FIG. 1.

Figure 12:
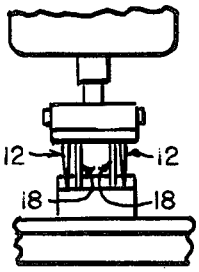
FIG. 12 is a fragmentary view taken along line 12—12 in FIG. 11 showing the relative position of the needles and knives in the improved sewing machine of the present invention.
Figure 13:
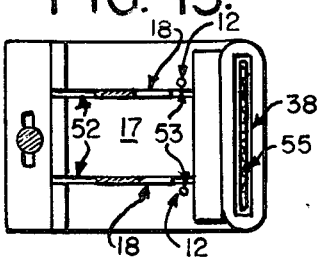
FIG. 13 is a sectional view taken along line 13—13 in FIG. 11, illustrating the presser foot and slots therein and the relative position of the knives and needle holes.
Figure 14:
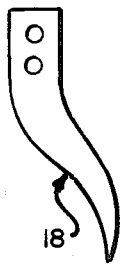
FIG. 14 is a side elevational view of a typical knife blade used in the present invention.

Referring now to FIGS. 12 and 13, the preferred arrangement of the needles 12 and knife blades 18 of the modified machine 10 of the present invention is shown in greater detail. As shown and preferred, the two knife blades 18 are laterally disposed between the two needles 12. As will be described in greater detail hereinafter, the purpose of this is to assure that the slits cut by the knife blades 18 are between the stitches provided by the needles 12 during the sewing operation (see FIGS. 2 and 3). As further shown and preferred in FIG. 13, the knife blades 18 are spaced behind the needles 12 in the direction of feed of the material across the throat plate 16. In this manner, the material being fed across throat plate 16 is sewn or stitched in advance of each cut. As also shown in FIG. 13, a pair of slots 52 are disposed in a presser foot 17 above the throat plate 16 with the knife blades 18 being aligned with these slots 52 to facilitate the cutting operation. A typical one of the knife blades 18 is illustrated by way of example in FIG. 14. The presser foot 17 also includes a pair of holes 53 therein at the location of the needles 12 as well as a slot 55 for guiding the fastener tape 38 across the throat plate 16 as the garment 50 and backing material 54 are fed across the throat plate 16 during the formation of the zipper closable pocket entry.

Now referring to the presently preferred method of the present invention for forming a zipper closable pocket entry using the modified sewing machine 10 described with respect to FIGS. 10–14, illustrated by way of example in FIGS. 1–9 and 15–20. FIG. 1 illustrates the first step of the presently preferred method in which a pocket entry is to be formed in a garment 50 as the garment 50, fastener tape 38 and backing strip 54 are fed across throat plate 16 of the previously described modified sewing machine 10. The fastener tape 38, as was previously mentioned, is separated into its two component zipper strips 40 and 42 with their respective zipper chains 44 and 46 being twisted to be in opposed outwardly directed relationship. The garment 50, zipper strips 40, 42 and backing strip 54 are conventionally fed into the machine 10 and across throat plate 16 so that backing strip 54 is underneath garment 50 below the location of the desired pocket entry with zipper strips 40, 42 being on top of the garment 50 above the location of the desired pocket entry. The direction of feed of the material is represented by arrow 56 in FIGS. 1, 2 and 9, with the direction of stitching being represented by arrow 57 in FIG. 9. As shown and preferred in FIGS. 1 and 9, the sewing of the pocket entry is initially started with the knives 18 out of engagement to thus enable initial stitching to be provided before the first parallel cut 59 of the pocket entry, with zipper strips 40, 42 and backing material 54 initially being sewn in place at the location of the pocket entry by starting stitches 58. Thus, in this initial step of the method only the sewing needles engage the material advancing across the machine 10 with the knife blades 18 being out of engagement with needle bar 14 and raised so as not to cut the material. In this manner the initial forward end portion of the pocket entry to be formed is stitched but not slit.

Linkage 26 is then engaged by the operator to cause piston 22 to be lowered and the knife blades 18 to be placed in engagement with needle bar 14 for reciprocation therewith. The engaged knife blades 18 then are caused to reciprocate with the needles 12 to cut in advance of each stitch 58 as the knife blades 18 engage the materials 40, 42, 50, 54 at the location of the pocket entry to cut through these materials to define the edges of the pocket entry by parallel slits 60. At essentially the same time as these edges 60 are being formed, the stitches 58 are being sewn so as to stitch the zipper tape 38 to the garment 50 at the pocket entry (see FIGS. 2, 9).

Figure 3:
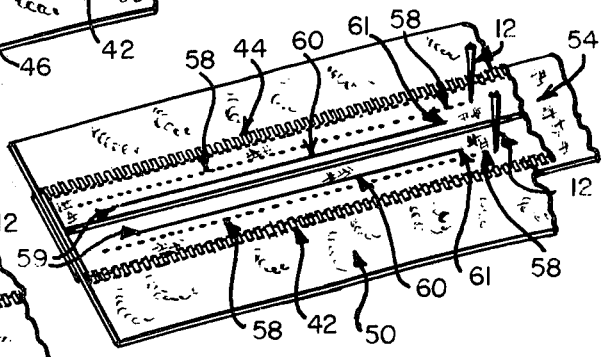
FIG. 3 illustrates a further step in the formation of the pocket entry of FIG. 1 as the garment continues to be fed across the throat plate, with the knives up, the needles still down and the stitching and cutting completed.
Figure 2:
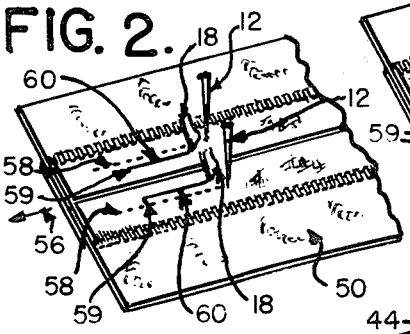
FIG. 2 illustrates a subsequent step in the formation of the pocket entry of FIG. 1 as the garment is fed across the throat plate, with the knives and needles down to provide simultaneous cutting and sewing of the pocket entry.
Figure 7:
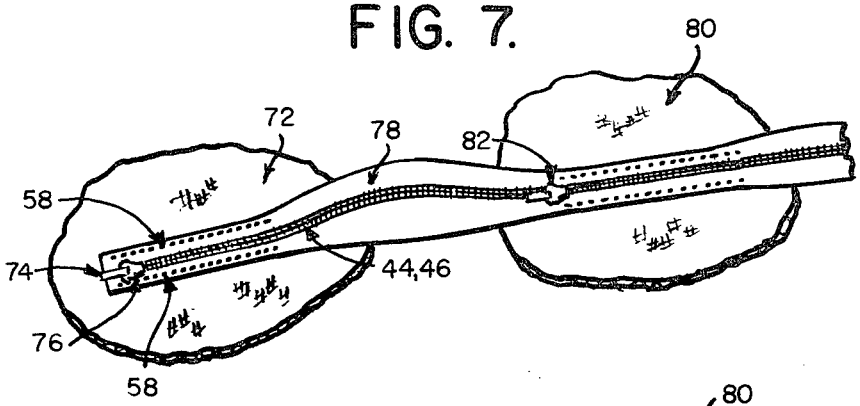
FIG. 7 illustrates a top perspective view similar to FIG. 3, illustrating mass production of pocket entries in accordance with the present invention in which two pocket entries, by way of example, are shown in various stages of formation.
Figure 8:
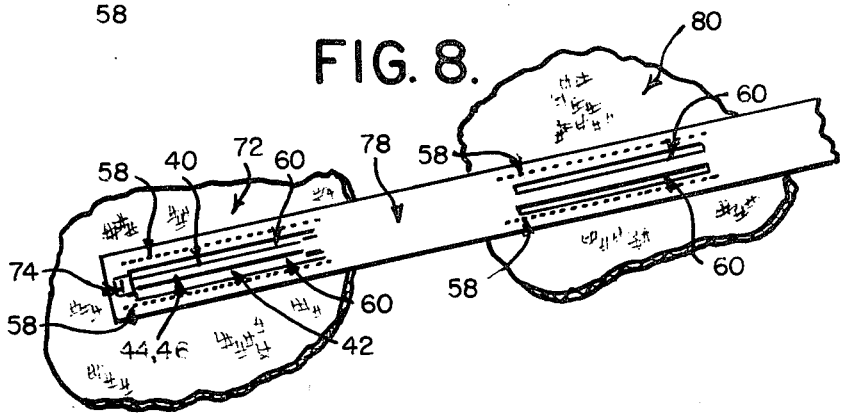
FIG. 8 is a bottom perspective view of the arrangement of FIG. 7.
Figure 9:
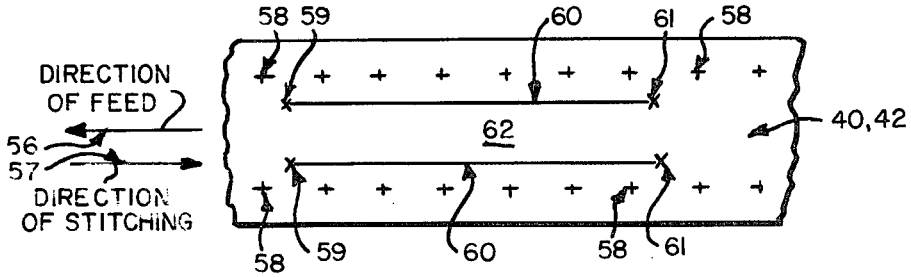
FIG. 9 is a graphic illustration of the cut and stitch arrangement employed in the formation of a typical pocket entry in accordance with the method of the present invention.

The length of the opening formed for the pocket entry is determined by the length of the slits 60 defining the edges of the pocket entry. Thus, when the desired length is attained, the operator engages linkage 30 to enable piston 22 to rise, disengaging the knife blades 18 from the needle bar 14 drive and raising the knife blades 18 out of contact with the material 40, 42, 50, 54. The operator then continues to stitch after the last cut 61 (FIG. 9) has been made to finish the stitching of the pocket entry (FIG. 3). Thereafter, the stitching and cutting operation by the machine 10 for that pocket entry is completed and the next pocket entry to be formed may be cut and stitched, such as illustrated in FIGS. 7 and 8. However, the pocket entry closure itself has not yet been completed, although the square miter at the ends of the formed pocket entry is now ready to be completed.

Figure 4:
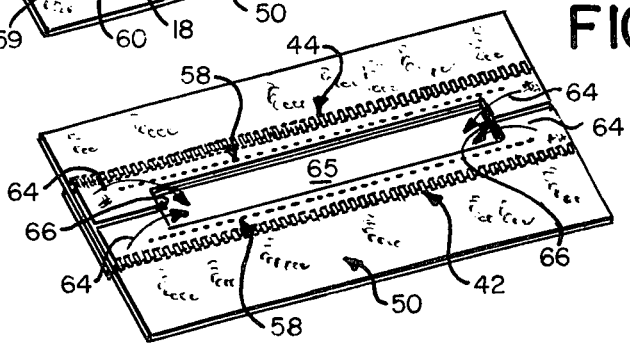
FIG. 4 illustrates a still further step in the formation of the pocket entry of FIG. 1, illustrating the provision of transverse cuts at the ends of the formed longitudinal slits so as to complete the pocket entry opening in a square miter with the square flaps being tucked under.
Figure 5:
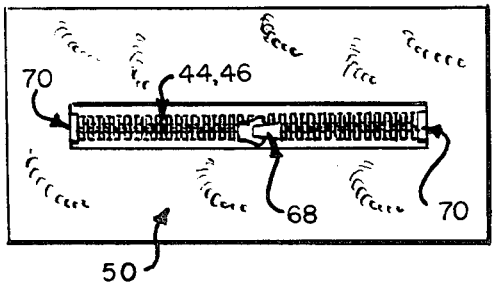
FIG. 5 illustrates a top plan view of the finished zipper closable pocket entry of FIG. 1.
Figure 6:
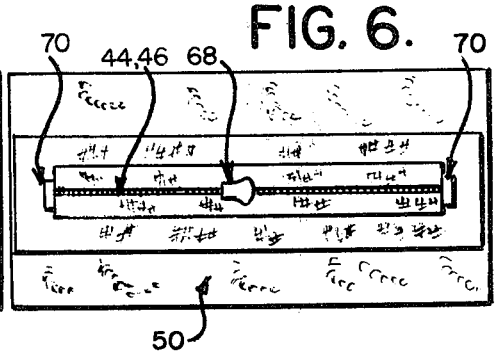
FIG. 6 illustrates a bottom plan view of the finished zipper closable pocket entry of FIG. 5.
Figures 15, 16, 17, 18, 19, 20:
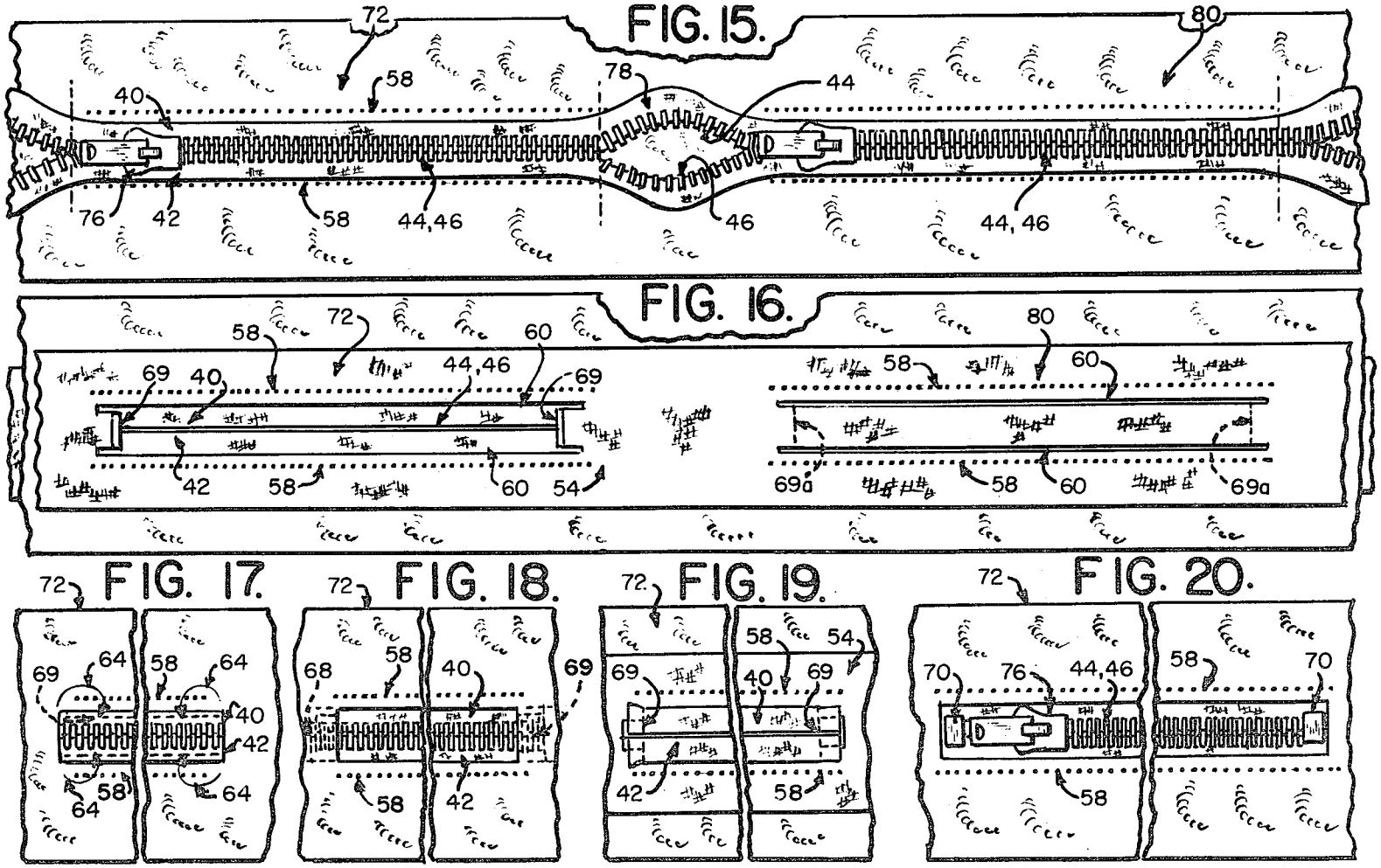
FIG. 15 is an enlarged top perspective view, similar to FIG. 7, illustrating two pocket entries in various stages of formation.
FIG. 16 is an enlarged bottom perspective view, similar to FIG. 8, of the arrangement of FIG. 15.
FIG. 17 is an enlarged fragmentary top perspective view of one of the pocket entries of FIG. 15 illustrating the step in the preferred method of the present invention prior to tucking of the cut zipper strip.
FIG. 18 is an enlarged fragmentary top perspective view, similar to FIG. 17, illustrating another step in the preferred method of the present invention after the zipper strip has been tucked.
FIG. 19 is an enlarged fragmentary bottom perspective view of the pocket entry of FIG. 18.
FIG. 20 is an enlarged fragmentary top perspective view of the finished pocket entry of FIGS. 15–19, similar to FIG. 5, with stops having been added.

Thus, the next step in the formation of the pocket closure is to make transverse cuts 63 in garment 50 and the backing material 54 to form the ends of the square miters FIGS. 4 and 16). The flaps formed by transversely cutting the garment 50 are tucked under in the direction of arrows 64 to form the square miter 69 at the ends of the pocket entry 65. Thereafter, a conventional zipper slide 68 which may have previously been conventionally mounted on zipper chains 44, 46 is used to automatically lock the two chains 44, 46 together in place, with a conventional zipper fastener 70 being conventionally provided at the ends of each pocket entry 65 which has been formed for providing a conventional zipper closure effect therefor by movement of the respective slide 68 longitudinally along the zipper chains 44, 46. If multiple pocket entries are being formed in a mass production environment, such as shown in FIGS. 7, 8 and 15–20, the fastener tape 40, 42 may then be cut at each pocket location just beyond the extremeties of the longitudinal extent of each of the pockets which separates the garments into individual separate garments as well as separating the connection between the individual pocket entry zipper closures. At this point the completed zipper closable pocket entry of the type illustrated in FIGS. 5 and 6 is provided with FIG. 6 being a plan view of the underside of the pocket entry zipper closure of FIG. 5.

As mentioned above, the method and apparatus provided by the present invention is particularly useful for mass production of zipper closable pocket entries in a plurality of garments. FIGS. 7 and 15 illustrate such mass production of pocket entries in different stages of formation in two different garments by way of example. The pocket entry in garment 72 includes one fastener 74 affixed to one end thereof with a zipper slide 76 movably mounted to the zipper chains. This closable pocket entry will be completed when a second fastener is affixed to the other end thereof and the excess fastener tape 78 is severed from the right side of that garment. In contrast, by way of example, the closable pocket entry on garment 80 is shown in a less completed stage than that of garment 72. To complete the pocket entry of garment 80, zipper slide 82 must be moved towards the center of the garment, fasteners must be provided at the ends of the pocket entry to limit the movement of the zipper slide, and excess fastener tape must be severed from both ends of the pocket entry. FIG. 8 illustrates a bottom perspective view of the arrangement described in FIG. 7.

FIGS. 15–20, which are similar to FIGS. 7 and 8, have been provided to illustrate, on an enlarged scale, the presently preferred method of the present invention for purposes of clarity with respect to the formation of the preferred square miter 69 of the present invention. The same reference numerals used in the description of FIGS. 1–9 are employed in FIGS. 15–20 for identically functioning elements. Thus, suffice it to say that FIG. 15 is similar to FIG. 7 and illustrates the stage wherein the zipper strips 40, 42 and backing material 54 are sewn in place at the pocket entries 72 and 80, with pocket entry 72 having already had transverse slits made in the back of the tape (FIG. 16) between the cuts 59 made by the machine to form the square miter 69. The location of these slits 69*a* for pocket entry 80 is illustrated by dotted lines 69*a* in FIG. 16 which is a back view of FIG. 15. FIG. 17 illustrates pocket entry 72 prior to the tucking of the cut ends of the zipper strips 40, 42 with FIGS. 18 and 19 illustrating pocket entry 72 immediately thereafter. Lastly, FIG. 20 illustrates the finished pocket entry 72 in a view similar to FIG. 5.

It is to be understood that the above described embodiments of the preferred method and apparatus of the present invention are merely illustrative of the principles thereof and that numerous modifications and embodiments of the invention may be derived without departing from the spirit and scope thereof.

What is claimed is:

1. In a sewing machine capable of forming a zipper closable pocket entry in a garment at a predetermined location therein from a zipper fastener tape fed to said sewing machine along with said garment, said sewing machine having a needle bar means, means for imparting reciprocating motion to said needle bar means, a pair of spaced apart sewing needles disposable in said needle bar means, a throat plate, and feed means for feeding said garment and zipper fastener tape to be sewn by said needles across said throat plate beneath said needles for enabling stitching thereby in accordance with said reciprocating motion of said needle bar means, said zipper fastener tape being disposable between said needles and said garment above said throat plate during said feeding; the improvement comprising a pair of spaced apart knife blades disposed inside of said spaced apart needles, each of said knife blades having a cutting edge disposed behind the needles in the direction of feed of said garment and zipper fastener tape across said throat plate; means for selectively engaging and disengaging said disposed knife blades with said needle bar motion imparting means for enabling reciprocating motion of said disposed knife blades in conjunction with said reciprocating motion of said needles as said garment and zipper fastener tape are fed across said throat plate when said knife blades are engaged with said needle bar motion imparting means, said selective engagement and disengagement means comprising means for enabling both sewing by said needles and cutting by said cutting edges of said garment and said zipper fastener tape being fed across said throat plate at such predetermined pocket location when said knife blades are engaged with said needle bar motion imparting means and for enabling solely sewing by said needles at said predetermined pocket location when said knife blades are disengaged from said needle bar motion imparting means, said knife blade cutting edges cutting said garment and zipper fastener tape being fed across said throat plate in advance of each stitch by said needles when said knife blades are engaged with said needle bar motion imparting means; whereby the slitting and stitching of said zipper closable pocket entry at such predetermined location may be substantially simultaneously accomplished by said reciprocating motion of said needle bar means.

2. An improved sewing machine in accordance with claim 1 wherein said knife blade cutting edges are disposed for enabling formation of a square miter at the ends of said zipper closable pocket entry.

3. An improved sewing machine in accordance with claim 1 wherein said feed means comprises presser foot means disposable adjacent said needle bar means in alignment with said knife blades and said needles for enabling guiding of said garment and said zipper fastener tape across said throat plate beneath said needles and knife blades during said feeding of said garment.

4. An improved sewing machine in accordance with claim 3 wherein said presser foot means comprises slots therein in alignment with said knife blade cutting edges for guiding said cutting edges during said cutting.

5. An improved sewing machine in accordance with claim 4 wherein said presser foot means comprises apertures therein in alignment with said needles for guiding said needles during said stitching.

6. An improved sewing machine in accordance with claim 5 wherein said presser foot comprises a guideway therein for said zipper fastener tape for facilitating feeding thereof across said throat plate in conjunction with said garment.

7. An improved sewing machine in accordance with claim 3 wherein said presser foot means comprises apertures therein in alignment with said needles for guiding said needles during said stitching.

8. An improved sewing machine in accordance with claim 3 wherein said presser foot comprises a guideway therein for said zipper fastener tape for facilitating feeding thereof across said throat plate in conjunction with said garment.

9. An improved sewing machine in accordance with claim 1 wherein said selective engagement and disengagement means comprises piston means for lowering said knife blades into engagement with said needle bar motion imparting means and raising said knife blades out of said engagement, and control means for controllably raising and lowering said piston means during formation of said zipper closable pocket entry.

10. An improved sewing machine in accordance with claim 9 wherein said control means comprises foot treadle means and linkage means operatively connected between said foot treadle means and said piston means.

11. An improved sewing machine in accordance with claim 1 wherein zipper tape is provided from a continuous zipper tape, said sewing machine feed means comprising means for feeding said continuous zipper fastener tape across said throat plate as a different pocket location in a garment is fed across said throat plate, whereby a plurality of zipper closable pocket entries may be formed for mass producing said zipper closable pocket entries.

12. An improved sewing machine in accordance with claim 11 wherein said zipper fastener tape includes associated zipper teeth chain for enabling zipper closure thereof, said continuous zipper fastener tape feed means comprising means for feeding said zipper fastener tape across said throat plate with said associated zipper teeth chain disposed along the outside edges of said zipper fastener tape.

13. An improved sewing machine in accordance with claim 12 wherein said feed means comprises presser foot means disposable adjacent said needle bar means in alignment with said knife blades and said needles for enabling guiding of said garment and said zipper fastener tape across said throat plate beneath said needles and knife blades during said feeding of said garment.

14. An improved sewing machine in accordance with claim 13 wherein said presser foot comprises a guideway therein for said zipper fastener tape for facilitating said feeding of said zipper fastener tape with said outside edge disposed zipper teeth chain across said throat plate in conjunction with said garment.

* * * * *